United States Patent [19]

Kirksey

[11] 4,242,861

[45] Jan. 6, 1981

[54] YARN TWISTER RING LUBRICANT

[75] Inventor: J. Frank Kirksey, Thomaston, Ga.

[73] Assignee: The General Tire & Rubber Company, Akron, Ohio

[21] Appl. No.: 122,107

[22] Filed: Feb. 19, 1980

Related U.S. Application Data

[63] Continuation of Ser. No. 927,796, Jul. 25, 1978, abandoned.

[51] Int. Cl.[3] ..... D01H 7/62; C10M 5/08; C10M 7/12; C10L 1/16

[52] U.S. Cl. ..... 57/120; 252/12; 252/12.2; 585/9

[58] Field of Search ..... 252/12, 12.2; 585/9; 57/120

[56] References Cited

U.S. PATENT DOCUMENTS

| | | | |
|---|---|---|---|
| 241,932 | 5/1881 | Colgan | 252/12 |
| 1,920,161 | 7/1933 | Rosen | 252/13 |
| 2,089,506 | 8/1937 | Rosen | 252/12 |
| 2,309,619 | 1/1943 | Flaxman | 252/12 |
| 2,320,002 | 5/1943 | Lutz et al. | 252/35 |
| 2,444,357 | 6/1948 | Maguire | 252/40 |
| 2,534,053 | 12/1950 | O'Halloran | 252/41 |
| 2,922,762 | 1/1960 | Morway | 252/41 |
| 3,025,560 | 3/1962 | Lindner | 252/12 |
| 3,621,645 | 11/1971 | Turst | 57/120 |
| 3,813,338 | 5/1974 | Coppock et al. | 252/41 |
| 3,816,346 | 6/1974 | Coppock et al. | 252/32.5 |

*Primary Examiner*—Delbert E. Gantz
*Assistant Examiner*—Irving Vaughn

[57] ABSTRACT

A twister ring lubricant is formulated using a major portion of paraffin wax and a minor portion of conventional oil or grease. In the manufacture of ply which is used in making cord, the individual filaments are fed through the eye of a nylon traveler which spins around a steel twister ring. Two or more plies are cabled to form a cord also using a traveler which spins around a twister ring. The twister ring lubricant reduces the sliding friction between the nylon traveler and the steel twister ring.

3 Claims, 8 Drawing Figures

CORD TWISTER #27 25H.P. 1300/3 POLYESTER 1" VERTICAL GREASE 3600 SPDL. RPM'S
X-CONTROL USING GREASE TO LUBRICATE O-TEST USING GRAX TO LUBRICATE

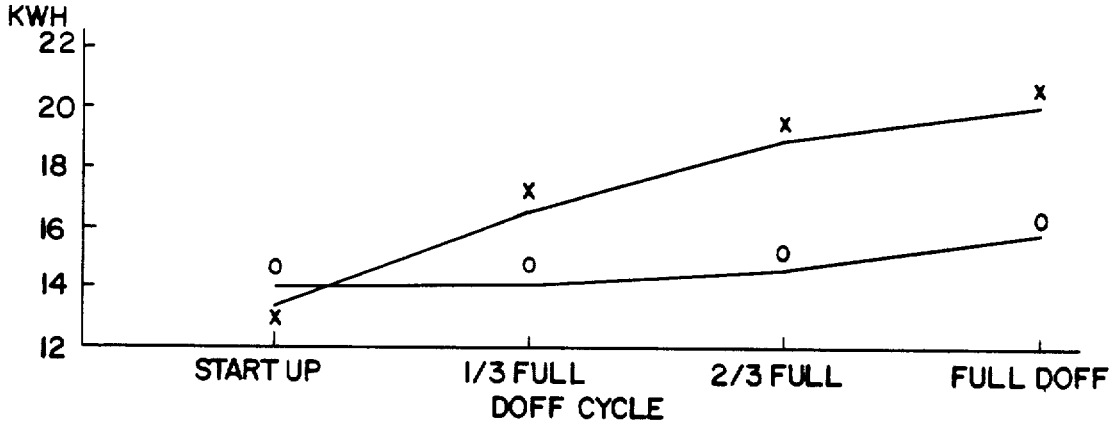

Fig. 3a

CORD TWISTER #49 20H.P. 1260/2 NYLON 1" VERTICAL NYSTEEL 3500 SPDL. RPM'S
X-CONTROL USING GREASE TO LUBRICATE O-TEST USING GRAX TO LUBRICATE

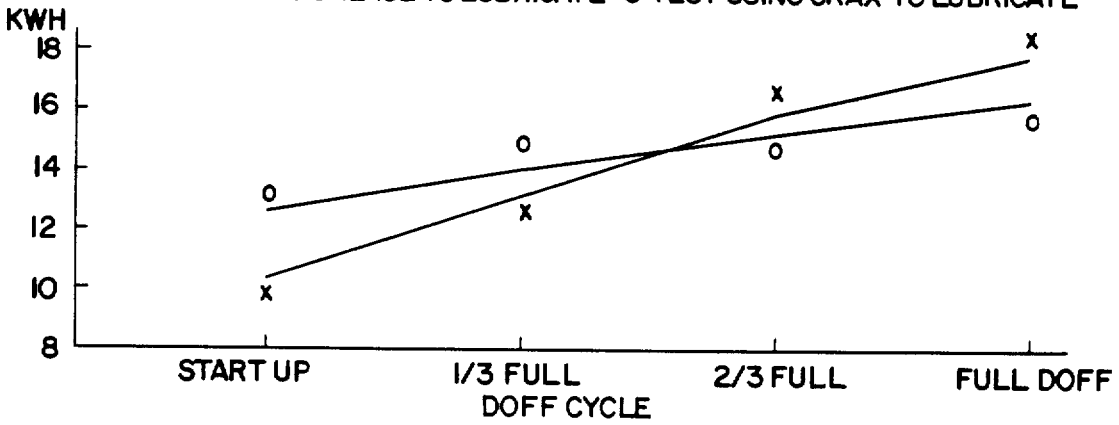

Fig. 3b

CORD TWISTER #8 20 H.P. 840/2/2 NYLON 43/64 DOUBLE VERT. GREASE 3560 SPDL. RPM'S
X-CONTROL USING GREASE TO LUBRICATE O-TEST USING GRAX TO LUBRICATE

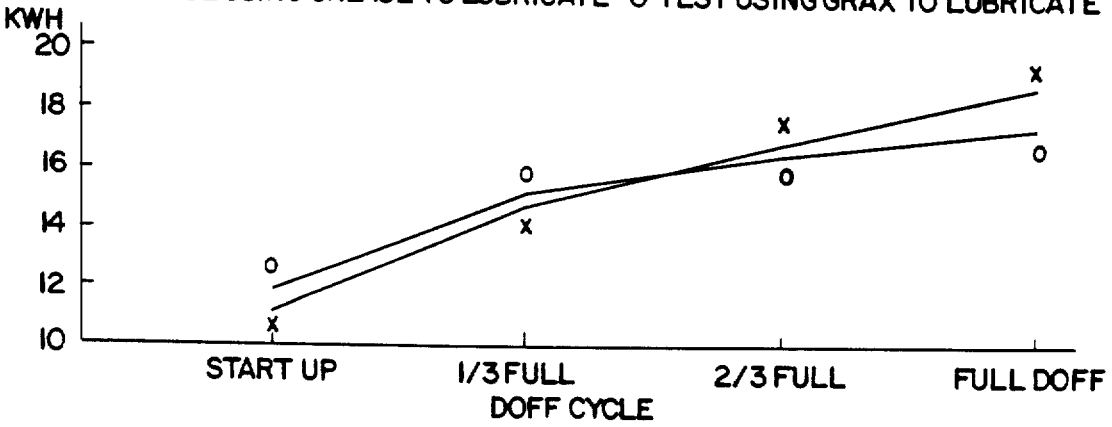

Fig. 3c

CORD TWISTER #18 25 H.P. 1300/3 POLYESTER 1" VERTICAL GREASE 3200 SPDL. RPM'S
X-CONTROL USING GREASE TO LUBRICATE O-TEST USING GRAX TO LUBRICATE

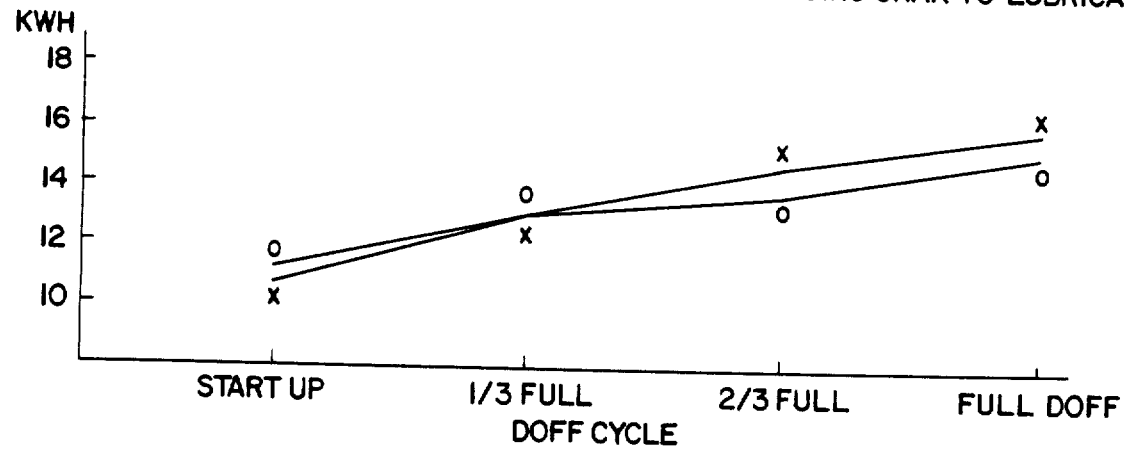

*Fig. 3d*

CORD TWISTER #30 25 H.P. 1000/1/3 POLYESTER 1" VERTICAL GROOVE 3570 SPDL. RPM'S
X-CONTROL USING GREASE TO LUBRICATE O-TEST USING GRAX TO LUBRICATE

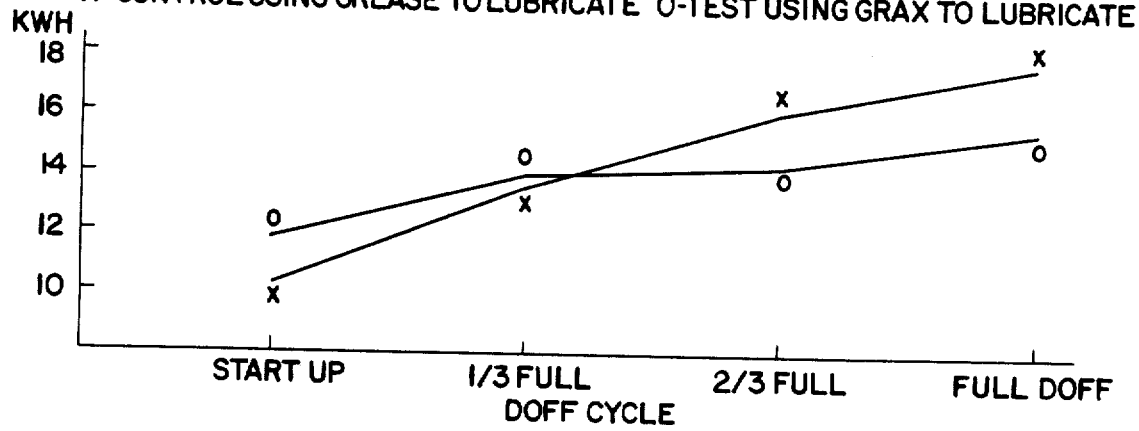

*Fig. 3e*

CORD TWISTER #43 20 H.P. 1300/1/3 POLYESTER 1" MULTIGROOVE GREASE 3500 SPDL. RPM'S
X-CONTROL USING GREASE TO LUBRICATE O-TEST USING GRAX TO LUBRICATE

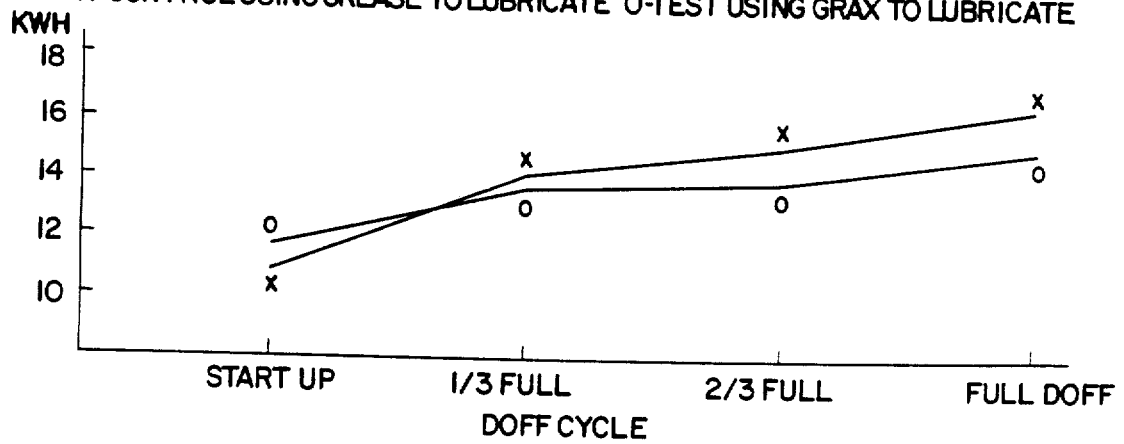

*Fig. 3f*

YARN TWISTER RING LUBRICANT

This is a continuation of application Ser. No. 927,796 filed July 25, 1978, abandoned.

This invention is directed to the composition used to lubricate twister rings used in the manufacture of yarn.

In the manufacture of yarn, an ingenious system was developed long ago to impart a twist to the yarn. This ingenious system involved the use of a traveler spinning around the periphery of a ring. Individual filaments were fed through the space at the top of the traveler, between the traveler and the twister ring onto a bobbin. The spinning of the traveler around the ring imparted a twist to the filaments forming a yarn. As the traveler depends upon the movement of the yarn to impart momentum to it, the frictional relationship between the traveler and the ring becomes important. If the friction is too great, the traveler will stick and the yarn will break.

A number of proprietary formulations are presently on the market for use as twister ring lubricants. As the start-up of the twister rings is at a low temperature, the lubricants presently used are fluid at a low temperature. They have the consistency of a light grease. The twister rings are lubricated by a man who puts some of this grease on his hands and runs his hands around the twister rings. When the rings heat up due to the traveler moving around the twister ring, the grease falls off, making a mess on the floor causing a fire hazard. Care must also be taken so that grease does not get on the twisted cord product. This reduces adhesion when the cord is used to reinforce a vehicle tire because the cord dip will not stick well to those areas of a tire cord which have been contaminated with twister ring grease.

In addition, the twister ring grease does not stay on the ring very long and must be replaced every 6 to 8 hours. A relatively large amount of electricity is consumed running the twister. The friction also generates heat which increases the electrical needs for the air conditioning equipment in the mill.

In order to eliminate the need for manual lubrication, porous twister rings were developed and lubricant under pressure was forced through the rings from the inside. These rings, since they were porous, tended to clog up due to particles in the grease, caused an oil mist to form, creating a mess; a slippery floor, and a fire hazard. Porous rings have also been known to be destroyed by corrosion due to the high temperatures generating acidic components in the grease.

An infringement and novelty search has been conducted and the most pertinent, the only prior art found was U.S. Pat. No. 3,816,346 discussed later.

It has been unexpectedly discovered that the addition of a major proportion of paraffin wax to conventional solid twister ring lubricants alleviates, to a large degree, the problem generated by the prior art. When using a major amount of paraffin in the twister ring lubricant, a 13% reduction in the electrical energy needed to spin the yarn was realized. This reduction in energy consumption will be multiplied because it will also be reflected in a similar savings in air conditioning costs. A 13% increase in production can also be achieved in lieu of a 13% reduction in electrical energy.

In addition, the paraffin containing lubricant does not mist, thus eliminating air pollution in the plant. The cord produced possibly has a superior quality because it is not contaminated with grease which reduces its adhesion to rubber. When used in clothing, the dyeability of cloth woven from the cord produced by the practice of the present invention is improved because there is much less contamination on the surface of the cord.

Due to the fact that the lubricant lasts for about 40 to 50 hours, only about 1/5th to 1/10th of the consumption of the paraffin base lubricant is required as compared to the prior art lubricant. In addition, the paraffin base lubricant is solid and far less messy to use than the prior art grease.

It is only necessary to apply a small amount to a small arc of the ring and the nylon traveler picks it up and spreads it. The paraffin base lubricant also reduces significantly the friction between the nylon traveler and the steel ring which allows the use of lighter travelers. Unfortunately, the paraffin base lubricant is so good that on some machines, the travelers spin too fast at shut down and causes the end of the yarn to kink because too much twist is imparted.

The paraffin constitutes on a weight percent basis, the major amount of the paraffin based lubricant. The minor constituent is a conventional grease used to lubricate the twister rings. Preferably, the level of the paraffin in the paraffin based lubricant is from 75% to 85% by weight. The conventional grease used as a twister ring lubricant contains a base oil which is fluid at room temperature. Preferably, the SUS viscosity at room temperature is in the range of from 30–600. For a disclosure of twister ring lubricants, see U.S. Pat. No. 3,816,346 of Coppock et at (1974). It is contemplated that the lubricant of the present invention can be formulated from paraffin and the base oil without the thickener. The paraffin wax used has a melting point above room temperature, 70° F. (27° C.) and preferably from 110° F. (44° C.) to 150° F. (65° C.), most preferably from 120° F. (49° C.) to 140° F. (60° C.). The oil is selected from the group consisting of hydrorefined naphthenic petroleum oil, hydrorefined paraffinic petroleum oil, solvent refined paraffinic petroleum oil and hydrogenated polyolefin oil and mixtures thereof.

Figure 1:
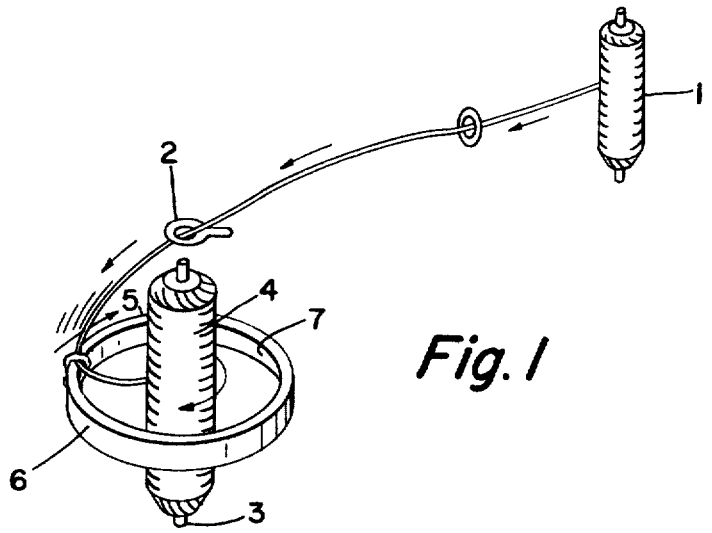
FIG. 1 is a highly simplified schematic drawing of a yarn twisting apparatus having the lubricant of the present invention on the twister ring.
Figure 2:
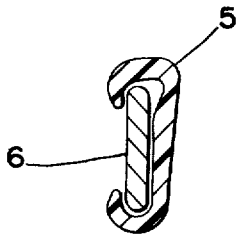
FIG. 2 is a drawing in cross-section of the traveler which spins around the periphery of the twister ring to impart a twist to the yarn.

FIGS. 3*a* through 3*f* are graphs which show the decreased electrical needs for operating twisters using the lubricant of the present invention as compared with the prior art grease.

The first ingredient of this formulation is 31.25% by weight of B-80 Extra Special Grease purchased from the Non-Fluid Oil Corporation. The grease contained 19.2% sodium salt of fatty acids (mainly oleic acid), 32.3% hydrocarbon wax and 48.5% mineral oil. The grease is basically the same as the grease as supplied by other companies to the textile industry.

The second component of the ring lubricant of the present invention is paraffin wax purchased from the Gulf Oil Corporation. The tradename of the paraffin is Gulf-Wax No. 40*. Any good quality paraffin could be substituted.

*See Footnote 2 for chemical analysis and manufactures specs.

Footnote 2

| | Gulfwax 40 |
|---|---|
| Gravity, ASTM D 287: API Theoretical | 41.3 |

-continued

| Footnote 2 | |
|---|---|
| Gulfwax 40 | |
| Melting Point, ASTM D 87: F | 140.1 |
| ASTM D 127: F | — |
| Congealing Point, ASTM D 938: F | 138 |
| Penetration, ASTM D 1321 @ 77° F. | 14 |
| @ 100° F. | 40 |
| Viscosity, SUS @ 150° F. | — |
| @ 180° F. | 46.8 |
| @ 210° F. | 41.6 |
| Flash, OC: F | 455 |
| Cloud Point, ASTM D 97: F | — |
| Color, Saybolt | +30 |
| Color, ASTM D 1500 | — |
| Odor, Solid State | slight |
| Liquid State | v. slight |
| Oil Content, ASTM D 721: % | 0.15 |
| Tensile Strength, ASTM D 1320: psi | 352 |
| Modulus of Rupture, TAPPI-655: psi | 422 |
| Oxidation Stability Test, 275° F. | |
| Proposed ASTM Method (1955) | |
| Induction Period: Minutes | 749 |
| Ultraviolet Absorptivity @ 290 mμ, ASTM D 2008 | <0.01 |
| API Classification | Type I |
| Blocking Point, ASTM D 1465 | |
| Picking Point: F | 99 |
| Blocking Point: F | 108 |
| Iodine Number | 0.4 |
| Molecular Weight | 442 |
| Refractive Index | 1.4359 |
| Distillation, Vacuum Corrected to 760mm $H_2$ | |
| 5% Point: F | 804 |
| 10% | 810 |
| 50% | 844 |
| 70% | 865 |
| 90% | 896 |

The Gulf-Wax No. 40 has a melting point of 140° F. (60° C.). The Gulf-Wax No. 40 is present at a level of 68.75% by weight of the total formulation. The total paraffin wax content is about 78.9%.

The two ingredients are brought to a molten state by placing them in a container which is lowered into boiling water. Stirring the mixture causes it to become homogenized. The mixture is then poured into molds to form a shape which can easily be held in the hand for application to twister rings. After cooling occurs, the resulting product is a solid lubricant. The best mode contemplated would be to mix the ingredients in a heated extruder and extrude it into a holdable bar shape.

The solid lubricant prepared was applied to twister rings used in the production of tire cord. The lubricant 7 was applied to an arc of about 60° on the inside of ring 6. As the traveler 5 moves by the applied lubricant 7, it picks up a small amount on the front face of the traveler, lubricates itself, and spreads the lubricant 7 around the ring.

The operation of the yarn twister is as follows.

From bobbin (1) a bundle of endless filaments are fed through eye 2. The spindle 3 turns bobbin 4 at a constant speed. The bundle of endless filaments are delivered at a speed sufficient to insert desired amount of twist as bundle moves along. The traveler 5 glides freely around ring 6. The tension caused by drag of traveler causes yarn to wind on bobbin at same rate of speed as it is delivered by rolls. The second step in the manufacture of tire cord is to take two or more plies of twisted filament bundles and feed them to the twister of FIG. 1. The resultant product is a multi-ply twisted cord.

It was found that the production of yarn due to the improved lubricant could be increased by 13%, that no mist of the lubricant occured, that 1/5th of the amount of lubricant as compared to the prior art was required, that the lubricant lasted for from 30 to as high as 50 hours, and that it was far less messy to use. The lubricant was used on a number of individual twisters in order to compare the electrical requirements as compared to the prior art grease. The results are set forth in Table I. "Grax" is the lubricant of the present invention.

TABLE I

| Twister No. | Motor Size | Spdl. rpm | Yarn Const. |
|---|---|---|---|
| 8 | 20 | 3600 | 840/2/2 |
| 8 | 20 | 3600 | 840/2/2 |
| 18 | 25 | 3200 | 1300/3 |
| 18 | 25 | 3200 | 1300/3 |
| 30 | 25 | 3600 | 1000/3 |
| 30 | 25 | 3600 | 1000/3 |
| 52 | 20 | 3600 | 1000/3 |
| 43 | 20 | 3600 | 1300/3 |
| 43 | 20 | 3600 | 1300/3 |
| 49 | 20 | 3600 | 1260/2 |
| 26 | 25 | 3600 | 1260/2 |
| 49 | 20 | 3600 | 1260/2 |
| 27 | 25 | 3600 | 1300/3 |
| 27 | 25 | 3600 | 1300/3 |
| 27 | 25 | 3950 | 1300/3 |
| 27 | 25 | 4250 | 1300/3 |
| 27 | 25 | 4250 | 1300/3 |
| 27 | 25 | 4600 | 1300/3 |

| Twister No. | Type Lub. | Trav. Size | KWH Per Doff | KWH Diff. |
|---|---|---|---|---|
| 8 | Grease | G-201-C | 135.0 | 8.1% |
| 8 | Grax | G-201-C | 124.9 | |
| 18 | Grease | J-212-C | 111.3 | 6.8% |
| 18 | Grax | J-212-C | 104.2 | |
| 30 | Grease | J-154-C | 130.5 | 5.0% |
| 30 | Grax | J-154-C | 124.3 | |
| 52 | Grease | J-154-C | 113.9* | |
| 43 | Grease | J-212-C | 114.6 | |
| 43 | Grax | J-212-C | 95.8 | 19.6% |
| 49 | Grease | J-154-C | 230.9 | |
| 26 | Grease | J-154-C | 233.0** | |
| 49 | Grax | J-154-C | 212.4 | 8.7% |
| 27 | Grease | J-212-C | 123.2 | (Control) |
| 27 | Grax | J-212-C | 101.8 | 21.0% |
| 27 | Grax | J-154-C | 94.2 | Spd. +9.7% KWH −30.8% |
| 27 | Grax | J-154-C | 102.4 | Spd. +18.1% KWH −20.7% |
| 27 | Grax | J-154-C | 102.1 | Spd. +18.1% KWH −20.7% |
| 27 | Grax | J-119-C | | Spd. +27.8% |

*20 H.P. Motor, compared to Twister #30, points out that 25 H.P. running @ 3600 is loafing and costing money.

** Same as above except reversed. #26 being underloaded, costing money.

No. 43 appears to be "odd", we have no explanation. Correct savings by simply changing to Grax seems to be around 8%. However, by increasing speed and changing traveler size (and using Grax) it seems we can gain 10% speed while lowering electrical consumption by 30%.

The lubricant of the present invention has been in the development stage for almost two years. In the beginning, attempts were made to use pure paraffin as the lubricant. This worked fine at operating temperatures but getting there was another problem. The frictional drag at start-up temperatures was too great so pure paraffin could not be used. Attempts were then made to formulate the paraffin with other lubricants to solve the start-up problem. All of the experimental work was done on one unit of ring twisters and usable product which was produced on the one unit was used in the manufacture of tires which were sold. It is now felt that the experimental period is drawing to a close and the lubricant of the present invention is beginning to be used on the several hundred other yarn twister units in the plant.

After a majority of the yarn twisters in the plant were converted to the lubricant of the present invention, the annual cost savings due to reduced energy used by the twisters was calculated based upon actual reduced electrical usage by the twisters. The savings exceeded $88,000 per year.

FIGS. 3*a, b, c, d, e* and *f* are the electrical usage of different yarn twisters from start-up using the lubricant of the present invention, (o) vs. the prior art grease (x). A twister ring, generally speaking, usually operates at an estimated 100° F. to 120° F. (38° C. to 50° C.).

The following Table II identifies the horsepower of the drive motor, the yarn twisted, the type of ring and the bobbin rpm.

TABLE II

| FIG. | HP | Yarn | | RPM |
|---|---|---|---|---|
| 3a | 25 | 1300 polyester | 1" vertical groove (25.4 cm) | 3600 |
| 3b | 20 | 1260/2 nylon | 1" (≈45°) vertical groove (25.4 cm) | 3500 |
| 3c | 20 | 840/2/2 nylon | 43/64" double horizontal groove ring (17 cm) | 3560 |
| 3d | 25 | 1300/3 polyester | 1"vertical (≈45) groove (25.4 cm) | 3200 |
| 3e | 25 | 1000/1/3 polyester | 1" vertical (≈45) groove | 3570 |
| 3f | 20 | 1300/1/3 | 1" multigroove ring | 3500 |

As can be seen from the graphs 3*a*–3*f*, electical usage during the initial period after start-up is higher for the lubricant of the present invention than for the prior art grease. Each graph represents a different twister. Electrical usage characteristics vary from twister to twister. After the initial period has elapsed, however, the electrical requirements for operating with the lubricant of the present invention are far less than the prior art grease.

It is contemplated that the use of a lower melting paraffin would decrease the energy requirements at start-up and that formulation will be tried.

The best paraffin wax contemplated for use in the present invention has a melting point of about 120° F.

All of the above test results were obtained using the 68.75% Gulf-Wax 40 composition.

Early work was done using household paraffin wax normally used for home canning. This wax melted somewhere in the neighborhood of 120° F. The drag was so great that about 20% of the travelers were pulled off of the rings. Then a 50—50 mixture of Non-Fluid Oil B-80 Extra Special Grease and household paraffin was formulated which worked but was sloppy to handle. A 60–40 mix of B-80 Extra Special Grease—household paraffin was tried and worked.

The cabled cord produced can be used for tires, conveyor belts, backing for vinyl upholstery and for clothing.

I claim:

1. In a method for twisting yarn by passing the yarn through the eye of a nylon traveler turning on a twister ring to twist the yarn and feed it onto a rotating bobbin, wherein the surface of the twister ring is lubricated with a lubricant comprising a mixture of a lubricating oil and a paraffin wax, the improvement comprising lubricating the surface of the twister ring in contact with the traveler with a solid lubricant consisting essentially of a minor amount of the lubricating oil having an SUS viscosity at 20° C. in the range of 30–600 selected from the group consisting of hydrorefined naphthenic petroleum oil, hydrorefined paraffinic petroleum oil, solvent refined paraffinic petroleum oil, hydrogenated polyolefin oil, and mixtures thereof and a major amount of the paraffin wax whereby the friction between the traveler and the twister ring is reduced.

2. In a method of lubricating a yarn twister ring wherein the improvement comprises applying to the ring a solid lubricant consisting essentially of a minor amount of lubricating oil having an SUS viscosity at 20° in the range of 30–600 selected from the group consisting of hydrorefined naphthenic petroleum oil, hydrorefined paraffinic petroleum oil, solvent refined paraffinic petroleum oil, hydrogenated polyolefin oil, and mixtures thereof and a major amount of paraffin wax whereby the friction between a traveler riding on the ring and the ring is reduced.

3. The method of claim 1 wherein the paraffin wax is present at a level of from 75% to 85%.

* * * * *